United States Patent [19]

Hoshiko et al.

[11] Patent Number: 4,765,533

[45] Date of Patent: Aug. 23, 1988

[54] ERECTABLE CONTAINER

[75] Inventors: Hidetoshi Hoshiko, Yokohama; Hideaki Kona, Tokyo; Masanori Yamamoto; Koichi Inoue, both of Osaka, all of Japan

[73] Assignee: House Food Industrial Company Limited, Higashiosaka, Japan

[21] Appl. No.: 904,357

[22] Filed: Sep. 8, 1986

[30] Foreign Application Priority Data

Sep. 10, 1985 [JP] Japan ..... 60-138624[U]

[51] Int. Cl.[4] ..... B65D 5/20

[52] U.S. Cl. ..... 229/101; 229/8; 229/41 C; 229/111; 229/126; 229/169

[58] Field of Search ..... 229/8, 43, 101, 126, 229/169, 41 C, 41 D, 113, 115; 426/111; D7/325

[56] References Cited

U.S. PATENT DOCUMENTS

| | | | |
|---|---|---|---|
| 619,757 | 2/1899 | Johnstone et al. | 229/922 |
| 2,698,709 | 1/1955 | Neuman | 229/43 |
| 3,306,518 | 2/1967 | Connellan | 229/8 |
| 4,279,933 | 7/1981 | Austin et al. | 426/111 |

FOREIGN PATENT DOCUMENTS

| | | | |
|---|---|---|---|
| 2533206 | 2/1976 | Fed. Rep. of Germany | 229/8 |
| 856245 | 6/1940 | France | 229/41 C |
| 640067 | 3/1960 | Italy | 229/126 |
| 189472 | 5/1964 | Sweden | 229/8 |

*Primary Examiner*—Stephen Marcus
*Assistant Examiner*—Gary E. Elkins
*Attorney, Agent, or Firm*—Oblon, Fisher, Spivak, McClelland & Maier

[57] ABSTRACT

An erectable container having a polygonal bottom plate is formed in the center of a foldable board member and side plates which are integrally provided extending from each edge of the bottom plate, at least one of the side plates being made in a pentagonal form. The pentagonal side plate is provided with two fold lines connecting between the vertexes at each end of the edge corresponding to the bottom plate and the vertex which is not adjacent thereto. An adhesive tab is provided on either one of each pair of lateral edges of the side plates which are adjacent to each other when the sides of the bottom plate are folded, so that, when each of the side plates is erected, the adhesive tab may join the side plates.

2 Claims, 4 Drawing Sheets

ERECTABLE CONTAINER

BACKGROUND OF THE INVENTION

1. Field of the Invention

The present invention relates to an erectable container which is composed of a single foldable plate member.

2. Description of the Prior Art

A variety of containers for containing food or the like and which are made of a board member such as paper or the like have been proposed. These containers are usually made in such a way that trapezoidal side boards are integrally provided adjacent each edge of an equilateral polygon, and adjacent edges of each side plate are made to adhere firmly to each other by adhesive tabs therebetween.

Consequently, in such a container, the shape of the upper opening is identical with, or conforms to, that of the bottom, so that the entire container is in the shape of an uninteresting truncated pyramid, making it difficult to realize novel designs.

Furthermore, when expandable material such as popcorn is put in a conventional container prior to heating, and then heated by a microwave oven and popcorn expands. If the upper opening portion is not changed so as to become generally circular, the capacity of the container does not become larger so that there is no sufficient space to continue popping the popcorn properly therein. Moreover, the conventional containers had many adhesive portions, which makes the manufacturing cost high.

OBJECT OF THE INVENTION

In view of the above-described disadvantages of the conventional containers, the present invention was made.

An object of the present invention is to provide a novel erectable container of a novel design which is composed of a single foldable board member and in which the shape of the bottom plate is different from that of the upper opening portion.

A further object of the present invention is to provide an erectable container in which the upper opening is relatively easy to deform so that, even if the contents, such as popcorn, expands to some extent, the deformation of the upper portion can cope with this expansion.

A still further object of the present invention is to provide an erectable container which allows the edges of the upper opening portion to be formed in the same horizontal plane, which makes it easy for the opening portions to be provided with a lid or to be stacked.

DESCRIPTION OF THE INVENTION

According to the present invention, the above and other objects can be accomplished by an erectable container formed from a single foldable board member defining a polygonal bottom plate formed in a center portion of the board member, pentagonal side plates each having an edge common with an edge of the bottom plate, the pentagonal side plates having a pentagonal form including five vertices, two of said vertices being at the ends of the common edge, each of the pentagonal side plates defining at least two fold lines, each of the fold lines being connected between one of the two vertices and a vertex of the pentagonal side plate which is not adjacent to either of the two vertices. Trapezoidal side plates each have an edge in common with edges of the bottom plate, wherein the pentagonal and trapezoidal side plates alternate with one another. Adhesive tabs extend from the fold lines at side edges of each of the pentagonal side plates. Folding tabs extend from fold lines at top edges of each of the pentagonal and trapezoidal side plates, opposite to the common edge thereof. All of the fold lines have the same sense and the tabs can join the pentagonal and trapezoidal side plates when the board member is folded to erect the container. The side plates are dimensioned such that the top edges thereof form a plane when the board member is folded to erect the container.

In a preferable aspect of the present invention, the bottom plate is of a rectangular form and pentagonal side plates are provided on two opposite sides of the bottom plate.

In another preferable aspect of the present invention, when the side plates have been erected, their upper edges form a plane, and a folding tab is integrally provided on each outer edge of said side plates.

The above and other objects and features of the invention will become apparent from the following description of a preferred embodiment taking reference to the accompanying drawings.

PREFERRED EMBODIMENT

Figure 1:
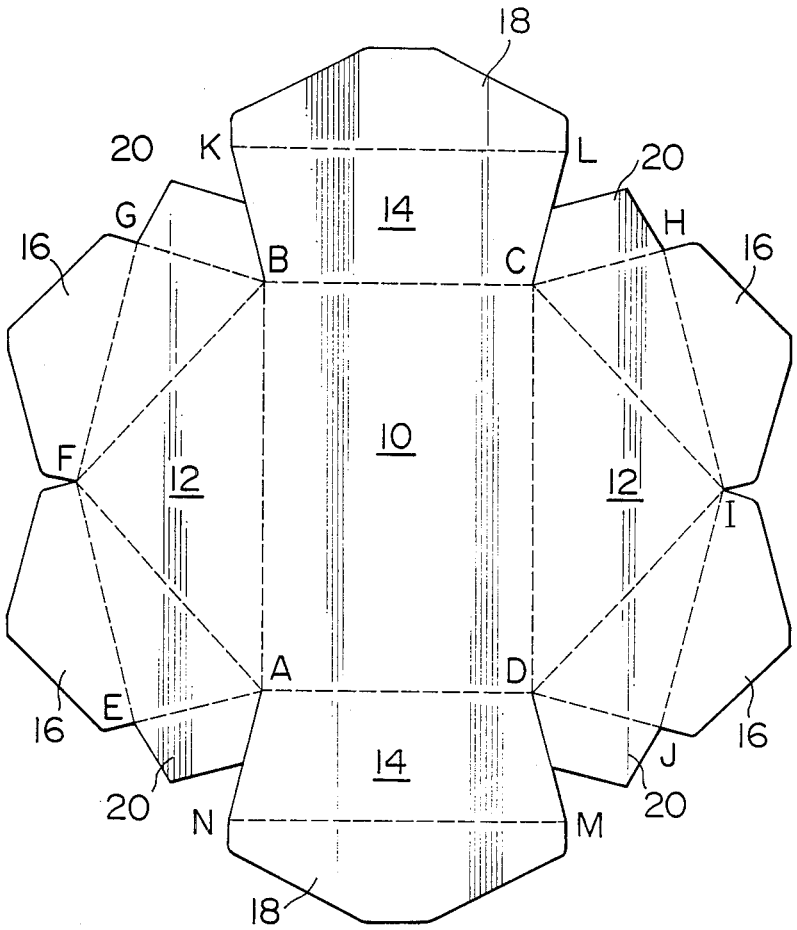
FIG. 1 shows a developed plan view of the embodiment of the erectable container according to the invention.

The embodiment of the present invention is hereinafter described with reference to the appended drawings. The present embodiment relates to an erectable container for containing popcorn prior to heating which is suitable for heating popcorns contained therein by means of a microwave oven or the like. The container, as shown in FIG. 1, is formed by cutting a single foldable plate member along cutting lines indicated by solid lines and by folding it along the broken lines. Namely, a bottom plate 10 is formed in the shape of a rectangle having vertices A-B-C-D and pentagonal side plates 12 are formed as shapes having vertices BAEFG and CDJIH with, edges AB and CD respectively as their bases. In addition, trapezoidal side plates 14 are formed, with, edges BC and AD as their bases, and with vertices BCLK and ADNM. In this case, edges AN, AE, BG, BK, CL, CH, DJ and DM are all of the same length.

Folded tabs 16 are provided along the top edges EF, FG, HI and IJ of the pentagonal side plates 12, i.e., those edges opposite the common edges, and folded tabs 18 are provided along the top edges KL and MN of the trapezoidal side plates 14.

In this embodiment, the edges AB, BC, CD and DA of the bottom plate, the top edges of the pentagonal side plate 12 EF, FG, HI and IJ, the lateral edges AE, BG, CH and DJ of the pentagonal side plates 12 and the top edges KL and MN of the trapezoidal side plates 14 are all folded inward. Fold lines AF, BF, CI and DI connecting vertexes A, B, C and D of the bottom plate to vertexes F and I of the pentagonal side plates 12 are also provided on the pentagonal side plates 12.

Figure 3:
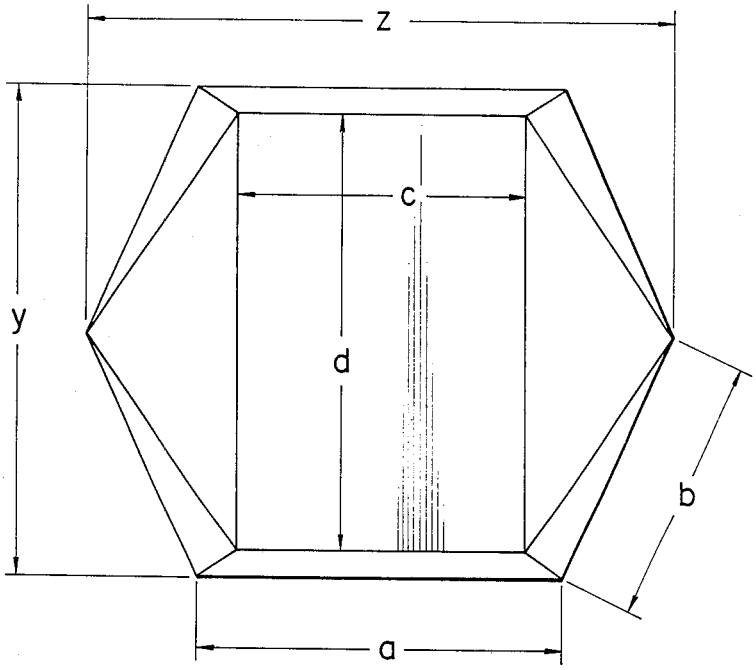
FIG. 3 shows a bottom view of the erected container.
Figure 4:
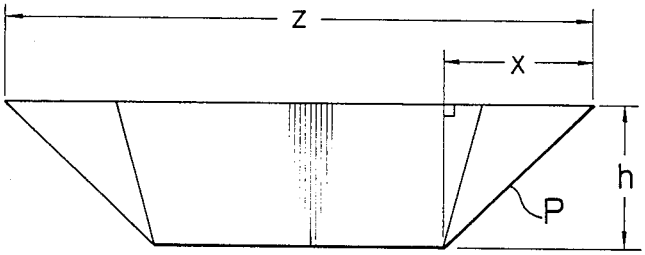
FIG. 4 shows a side elevational view of the erected container.

A method of designing the same container is now described. In FIG. 1, let us assume that an angle BGF=90°, an angle formed between the extension of the edge BC and the edge BG=15°, an angle GFB=30°, and the angle formed between the extension of the edge AB and the side BK=15°. Meanwhile, in FIG. 3 illustrating the bottom surface of the folded container and in FIG. 4 illustrating the lateral side, if dimensions are determined as q, b, c, z or y, h, then $$x=(z-c)/2$$

and the height P of the pentagonal side plate 12 can be obtained from the following formula.

$$P=\sqrt{x^2+h^2}$$

Figure 2:
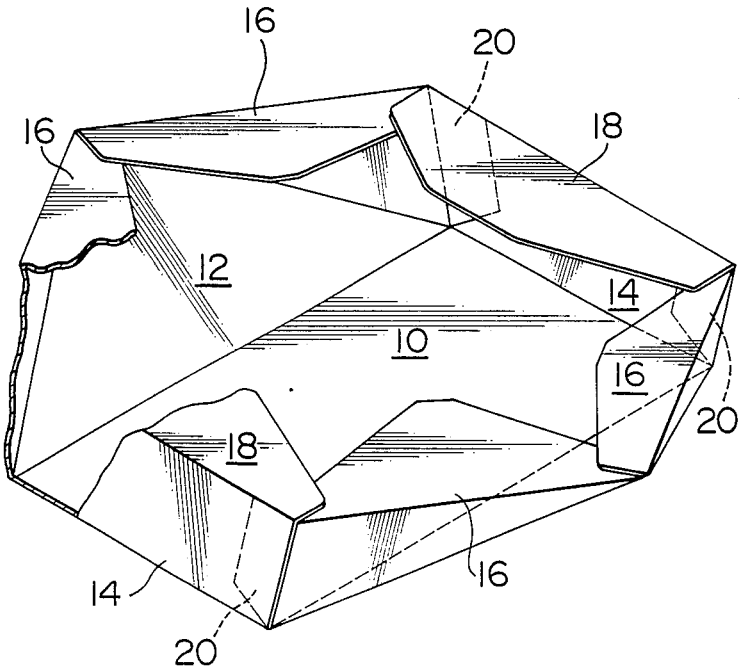
FIG. 2 shows a perspective view of the erected container.

In the above-described construction, each fold line is folded at a certain angle and, as shown in FIG. 2, the pentagonal side plates 12 and the trapezoidal side plates 14 are erected, so that edges AN and AE, edges BG and BK, edges CL and CH, and edges DJ and DM may respectively come in contact with each other. In addition, rear surfaces (outer lateral surfaces) of adhesive tabs 20 are made to stick to the surface (inner lateral surface) of the trapezoidal side plate 14, so that the above folded state may be fixed. In this container, the angle formed by the bottom plate 10 and the pentagonal side plate 12 can be varied so that the inclination of edges EF, FG, HI and IJ with respect to the bottom plate 10 can be varied, and the edges EF, FG, KL, HI and IJ forming the edges of the upper opening portion can be aligned in a plane parallel to the bottom plate.

Figure 5:
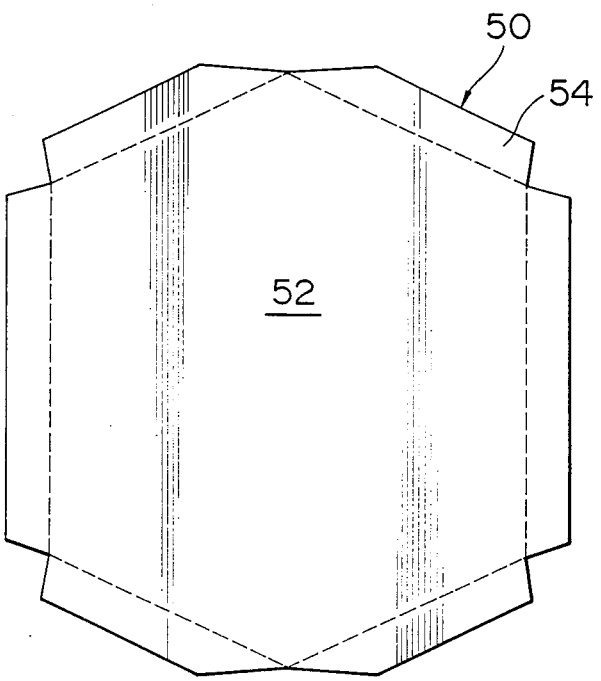
FIG. 5 shows a developed plan view of the lid.

In the container according to the present invention, lids 50 are combined, if necessary. As shown in FIG. 5, the lid 50 is composed of a top plate 52 which coincides with a hexagonal opening portion when the edges of the upper opening portion of the container 10 are aligned in the same plane, and cover tabs 54 which are provided along each edge (fold line) thereof. Cover tabs 54 are folded into the lid by folding them in the same direction with respect to the top plate 52. These lids 50 can be used as a stand when the container is heated by a microwave oven or the like, or folded in the form of a trapezoid. The board for forming the container and the lids is processed in its inner surface in a water-proof manner, depending on the property of the content, while the fold lines are seamed by a sewing machine.

Furthermore, though, in the above-described embodiment, the bottom plate is of rectangular form and the opening portion of hexagonal form, if the bottom plate is formed having X-angles and the number of pentagonal side plates is Y, then the opening portion will have (X+Y), and the container having a multiplicity of shapes other than the above-described embodiment can be made in accordance with that relationship.

As described above, the container according to the present invention can be made inexpensively since it can be formed of a single foldable board member and the number of the positions where each portion is adhered is small. Furthermore, in this container, the number of edges of the upper polygonal opening is large compared with that of the polygonal bottom plate, which allows the novel design to be created, while offering a great convenience when the contents are is placed in and taken out of the container, since the area of the upper opening portion is larger than that of the bottom plate. Furthermore, since the angle at which the board is folded along the fold lines within the pentagonal side plates can be changed in a relatively easy manner and the shape of the opening portion can be deformed in accordance with a force applied from the interior or the exterior of the container, popcorns can effectively be contained when, due to heating, it expands and jumps within the container. Furthermore, since this container can be flattened at the opening portion, it is suitable for being stacked and having a lid placed thereon.

The invention has thus been shown and described with reference to a specific embodiment, however, it should be noted that the invention is in no way limited to the details of the illustrated structures but changes and modifications may be made without departing from the scope of the appended claims.

We claim:

1. An erectable container formed from a single foldable board member, said board member defining:

a polygonal bottom plate formed in a center of said board member;

pentagonal side plates each having an edge common with an edge of said bottom plate, said pentagonal side plates having a pentagonal form including five vertices, two of said vertices being at ends of said common edge, each said pentagonal side plate defining at least two fold lines, each of said fold lines being connected between one of said two vertices and a vertex of said pentagonal side plate which is not adjacent to either of said two vertices; and trapezoidal side plates each having an edge in common with edges of said bottom plate, wherein said pentagonal and trapezoidal side plates alternate with one another;

adhesion tabs extending from fold lines at side edges of each of said pentagonal side plates;

folding tabs extending from fold lines at top edges of each said pentagonal and trapzeoidal side plates, opposite said common edge thereof;

wherein all of said fold lines have the same sense and said tabs can join said pentagonal and trapezoidal side plates when said board member is folded to erect the container, and wherein said side plates are dimensioned such that said top edges thereof form a plane when said board member is folded to erect said container.

2. The erectable container of claim 1, wherein said bottom plate is rectangular.

* * * * *